US006902134B2

(12) United States Patent
Green et al.

(10) Patent No.: US 6,902,134 B2
(45) Date of Patent: Jun. 7, 2005

(54) DISPENSER FOR ROLLED PAPER

(75) Inventors: Jonathan Green, Warlingham (GB); Joseph Elisabeth Oberdorf, Rotterdam (NL); Bastiaan Roelof Tjaden, Leiden (NL)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 10/242,189

(22) Filed: Sep. 12, 2002

(65) Prior Publication Data

US 2004/0050993 A1 Mar. 18, 2004

(51) Int. Cl.[7] ..... A47K 10/38; B65H 16/06

(52) U.S. Cl. ..... 242/598.3; 225/106; 242/566; 242/596.8; 242/598.6

(58) Field of Search ..... 242/564.4, 565, 242/566, 580, 592, 595, 595.1, 596, 596.7, 598.3, 598.4, 598.5, 598.6, 599, 599.3; 225/46, 47, 51, 52, 76, 77, 80, 84, 85, 100, 106

(56) References Cited

U.S. PATENT DOCUMENTS

| | | | | | |
|---|---|---|---|---|---|
| 462,479 | A | * | 11/1891 | Evans | 194/255 |
| 1,025,312 | A | * | 5/1912 | Rydquist | 242/564.1 |
| 1,026,128 | A | * | 5/1912 | Rydquist | 226/130 |
| 1,122,673 | A | | 12/1914 | Winter et al. | |
| 1,122,674 | A | | 12/1914 | Winter et al. | |
| 2,138,154 | A | | 11/1938 | Grunwald | |
| 2,206,320 | A | * | 7/1940 | Grunwald | 225/16 |
| 2,298,179 | A | * | 10/1942 | Steiner et al. | 226/131 |
| 2,555,885 | A | | 6/1951 | Hope | |
| 2,592,786 | A | * | 4/1952 | Birr | 242/564.1 |
| 3,127,121 | A | * | 3/1964 | Babin | 242/596.3 |
| 3,156,392 | A | | 11/1964 | Johannes | |
| 3,301,617 | A | | 1/1967 | Goodwin et al. | |
| 3,428,267 | A | | 2/1969 | Briles | |
| 3,770,172 | A | | 11/1973 | Nystrand et al. | |
| 4,119,255 | A | | 10/1978 | D'Angelo | |
| 4,179,078 | A | | 12/1979 | Mansfield | |
| 4,690,344 | A | | 9/1987 | Yokota | |
| 4,804,149 | A | | 2/1989 | Murphy | |
| 5,048,589 | A | | 9/1991 | Cook et al. | |
| 5,294,617 | A | | 3/1994 | Venkatesan et al. | |
| 5,399,412 | A | | 3/1995 | Sudall et al. | |
| 5,674,590 | A | | 10/1997 | Anderson et al. | |
| 5,772,845 | A | | 6/1998 | Farrington, Jr. et al. | |
| 5,875,985 | A | | 3/1999 | Cohen et al. | |
| 5,904,316 | A | | 5/1999 | Dunning et al. | |
| 5,904,971 | A | | 5/1999 | Anderson et al. | |
| 6,070,821 | A | | 6/2000 | Mitchell | |
| 6,196,493 | B1 | * | 3/2001 | Tanaka | 242/564.4 |
| 6,248,212 | B1 | | 6/2001 | Anderson et al. | |
| 6,273,996 | B1 | | 8/2001 | Hollenberg et al. | |
| 6,412,655 | B1 | | 7/2002 | Stuetzel et al. | |

FOREIGN PATENT DOCUMENTS

| | | |
|---|---|---|
| EP | 0331653 A2 | 9/1989 |
| EP | 0878161 A1 | 11/1998 |
| GB | 1327954 | 8/1973 |

* cited by examiner

*Primary Examiner*—Kathy Matecki
*Assistant Examiner*—Scott Haugland
(74) *Attorney, Agent, or Firm*—Richard M. Shane

(57) ABSTRACT

The present invention provides an apparatus for dispensing rolled sheet material, the apparatus including a housing defining an interior adapted to contain rolled sheet material and a dispensing opening for allowing sheet material to be dispensed from the interior of the housing. The apparatus further includes a nip within the housing such as, for example, may be formed by first and second rollers. In addition, the apparatus includes a mobile roll support system adapted to support a roll of sheet material within the housing wherein the roll of sheet material rotates to dispense sheet material and further wherein the mobile roll support system and the roll of sheet material move toward the nip as sheet material is dispensed.

30 Claims, 12 Drawing Sheets

DISPENSER FOR ROLLED PAPER

FIELD OF THE INVENTION

The present invention relates to an apparatus for no-touch dispensing of sheet material from a roll of sheet material.

BACKGROUND OF THE INVENTION

No-touch dispensers, i.e., dispensers that do not require the patron to touch any part of the dispenser, are desired for many reasons. No-touch dispensing reduces the chance of transferring disease-causing bacteria, viruses and other microorganisms. No-touch dispensing also makes the process of obtaining a sheet simpler and quicker.

Single-sheet dispensers, i.e., dispensers that dispense a consistent, fixed quantity of sheet material, are also desired for many reasons. They tend to reduce the quantity of sheet material used by an individual patron, thereby saving on material costs, disposal costs, and costs associated with the frequency whereby the dispensers must be refilled.

No-touch, single-sheet dispensers for folded, interleaved sheets are known, however the manufacturing processes associated with providing the folded, interleaved sheets are more expensive and complex than the process associated with providing roll products.

No-touch, single-sheet dispensers utilizing knives or other cutting devices to cut sheet material from a roll of sheet material are known, but knives and other cutting devices may present a danger to either a patron or an individual refilling the dispenser.

No-touch, single-sheet dispensers for rolled products via zones of weakness are known, but if the sheet material tears before the next zone of weakness emerges from the dispenser, the next patron has no sheet material to grasp.

No-touch, single-sheet dispensing of double rolled products via offset zones of weakness is also known, but dispensers for these products still have disadvantages that have yet to be overcome. As an example, these dispensers can be difficult to load. As another example, if the force applied by a patron to remove the sheet material from the dispenser is distributed evenly across the width of the sheet material, the zones of weakness may not separate, causing more than one sheet to be removed from the dispenser. The features of the dispenser disclosed herein overcome these and other disadvantages of prior art dispensers.

SUMMARY OF THE INVENTION

The aforesaid needs are fulfilled and the problems experienced by those skilled in the art overcome by the apparatus for dispensing rolled sheet material of the present invention. In one embodiment, the apparatus includes a housing defining an interior adapted to contain rolled sheet material and a dispensing opening for allowing sheet material to be dispensed from the interior of the housing. The apparatus further includes a nip within the housing such as, for example, may be formed by first and second rollers. In addition, the apparatus includes a mobile roll support system adapted to support a roll of sheet material within the housing wherein the roll of sheet material rotates to dispense sheet material and further wherein the mobile roll support system and the roll of sheet material move toward the nip as sheet material is dispensed. Desirably, the housing further comprises a first housing section and a second housing section with the first housing section being at least partially removably attached to the second housing section.

Desirably, the roll of sheet material comprises one or more layers of sheet material having zones of weakness therein. Even more desirably, the layers of sheet material comprise a plurality of offset zones of weakness that substantially extend across the width of the sheet material.

In a further aspect, the apparatus comprises first and second tracks, each track engaging the mobile roll support system wherein the mobile roll support system travels within the tracks as the roll of sheet material is dispensed. Desirably, the tracks are parallel to one another, and even more desirably the tracks are angled downwardly wherein the mobile roll support system moves toward the nip as the sheet material is dispensed and the diameter of the roll of sheet material decreases. By way of nonlimiting example, one or both of the tracks may be a slot defined within the side of the housing. The slots may have various configurations with respect to the sections that are part of the housing. The slots may be defined between the first and second housing sections, may be wholly contained within one of the first and second housing sections, or may extend from within the first housing section to within the second housing section.

In still a further aspect, the mobile roll support system comprises a dispensing roller having first and second ends, each end slideably engaging a track. Such a mobile roll support system is desirable for dispensing rolls of sheet material that are wound about a central core. Alternatively, the mobile roll support system can comprise at least two separate mobile supports, each support being slideably engaged within a track. Such a mobile roll support system is desirable for dispensing rolls of sheet material that are coreless or that are wound throughout their entire diameters. For dispensing coreless rolls of sheet material, the mobile roll supports desirably comprise an engaging member attached to the supports. The engaging member is adapted to engage one side of a roll of sheet material. The engaging member is desirably adapted to extend into the interior of the rolled sheet material.

Desirably, the nip comprises at least one roller. More desirably, the nip is pressurized. As one example, the nip may be pressurized by at least one spring. Desirably, the roll of sheet material supported by the mobile roll support system rests against one of the nip rollers and the path of the sheet material extends through the nip and through the dispensing opening.

Other features and aspects of the present invention are discussed in greater detail below.

BRIEF DESCRIPTIONS OF THE DRAWINGS

DETAILED DESCRIPTION

Figure 1:
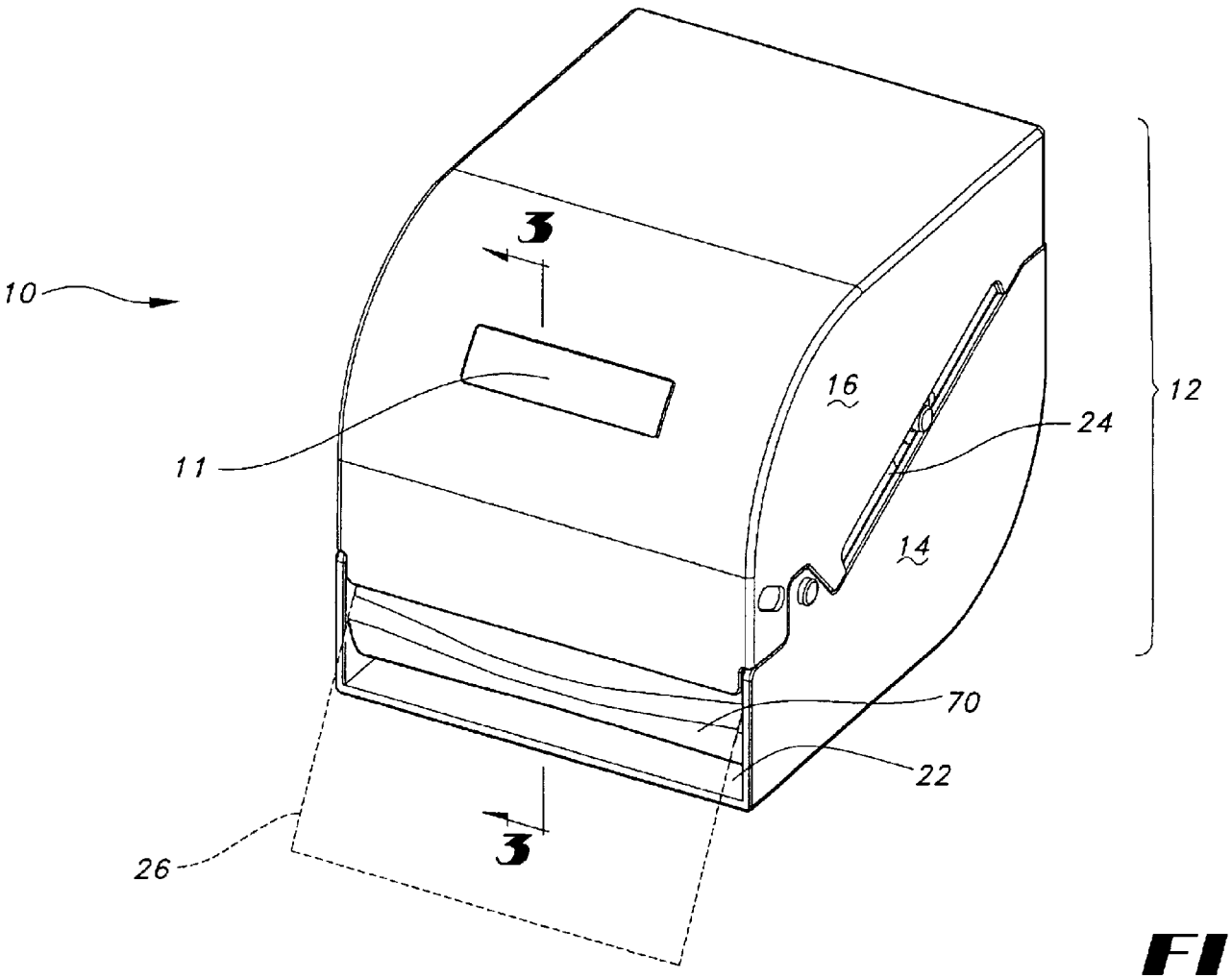
FIG. 1 is a perspective view of a dispenser of this invention.

Reference will now be made in detail to the various embodiments of the invention, one or more examples of which are illustrated in the drawings. Each example is provided by way of explanation of the invention and is not meant as a limitation of the invention. For example, features illustrated or described as part of one embodiment or figure can be used on another embodiment or figure to yield yet another embodiment. It is intended that the present invention include such modifications and variations.

The present invention provides an apparatus for dispensing rolled sheet material. Exemplary sheet materials for which the present invention is suitable include, but are not limited to, absorbent sheet materials such as towels, wipers, tissue, and so forth. Suitable sheet materials are disclosed, by way of non-limiting examples only, in U.S. Pat. No. 5,048,589 to Cook et al., U.S. Pat. No. 5,399,412 to Sudall et al., U.S. Pat. No. 5,674,590 to Anderson et al., U.S. Pat. No. 5,772,845 to Farrington, Jr. et al., U.S. Pat. No. 5,904,971 to Anderson et al., U.S. Pat. No. 6,248,212 to Anderson et al., and U.S. Pat. No. 6,273,996 to Hollenberg et al., the entire contents of which are herein incorporated by reference. The sheet materials for which the present invention is suitable are desirably wound around a core, yet may, for other embodiments, be coreless. The sheet materials for which the present invention is suitable desirably have regularly spaced zones of weakness extending across the width of the sheet material. The zones of weakness are used to separate the sheet material into individual sheets and may be, for example, defined by a series of perforations. The sheet material having regularly spaced zones of weakness extending across its width is desirably double wound into a roll having inner and outer layers of sheet material wherein the zones of weakness for the inner and outer layers are offset as is taught in U.S. Pat. No. 3,770,172 to Nystrand, herein incorporated by reference in its entirety. Double wound sheet material having offset zones of weakness allows the sheet material to tear within the dispenser while still providing a tail of sheet material extending from the dispenser to be grasped by the next patron.

An embodiment of the dispenser of the present invention is depicted in FIG. 1 at 10. The dispenser 10 includes a housing 12 that comprises a first housing section 14 and a second housing section 16. When the first housing section 14 and the second housing section 16 are in the closed position (as depicted in FIG. 1), the first housing section 14 and the second housing section 16 together define a dispensing opening 22, a first angled slot 24, and a second angled slot on the opposite side wall (not depicted). Sheet material 26 is dispensed through the dispensing opening 22. Optionally, there may be a window 11 defined in one of the housing sections to allow viewing of the interior of the dispenser 10. The window 11 may be open, or may be constructed of a transparent or translucent material that permits viewing of the interior of the dispenser 10.

Figure 2:
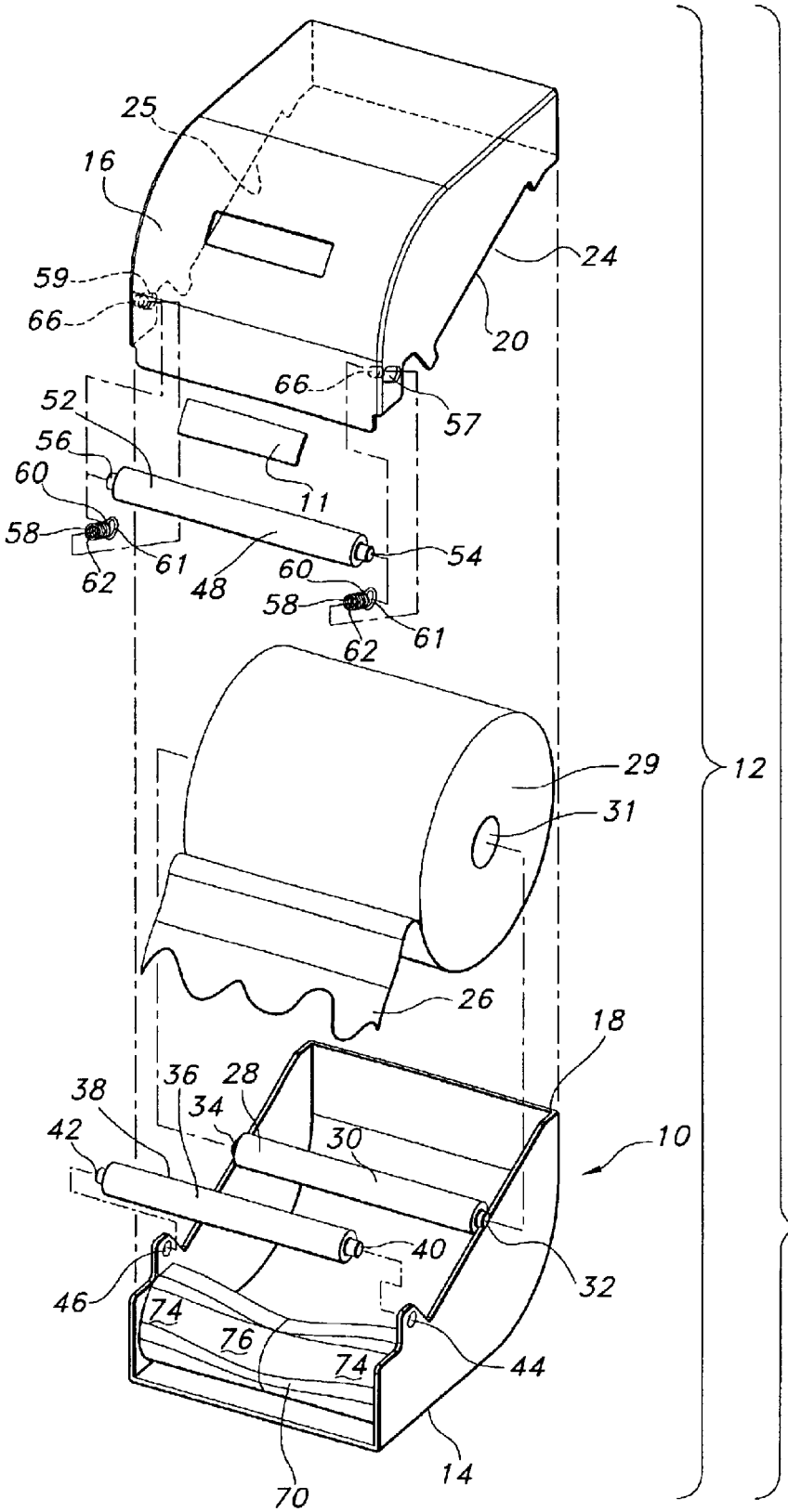
FIG. 2 is an exploded perspective view depicting the interior of the dispenser of FIG. 1.

Referring now to FIG. 2 that depicts the inside of the dispenser 10, the first housing section 14 has a top edge 18, while the second housing section 16 has a bottom edge 20. The top edge 18 and the bottom edge 20 fit together to form the housing 12. The top edge 18 and the bottom edge 20 are configured such that the first housing section 14 and the second housing section 16 will not separate during the dispensing operation. However, when it is necessary to reload the dispenser, the first housing section 14 and the second housing section 16 are readily separated. Methods of removably attaching parts in this manner are well known to those skilled in the art. Nonlimiting examples include snaps, latches, buckles, locks, hooks, buttons, pins, cotter pins, and so forth.

Within the housing 12 is a dispensing roller 28 that is adapted to support a roll of sheet material 29 having a central aperture 31. The dispensing roller 28 has a dispensing roller body 30, a first dispensing roller end 32, and a second dispensing roller end 34. The dispensing roller body 30 is desirably cylindrical, but may be any other shape that will support the weight of the roll of sheet material 29. It is contemplated that the dispensing roller 28 may support the roll of sheet material 29 from within the central aperture 31 or, alternatively, may support the roll of sheet material 29 through contact with the outside surface of the roll of sheet material 29. The first and second dispensing roller ends 32, 34 are slidingly engaged by the first and second angled slots 24, 25 that form when the first housing section 14 and the second housing section 16 are closed together. The first and second dispensing roller ends 32, 34 may be fixed with respect to the dispensing roller body 30 or may, alternatively, rotate independently from the dispensing roller body 30. The first and second dispensing roller ends 32, 34 are desirably cylindrical, but may be any other shape that will slideably engage the first and second angled slots.

Figure 2A:
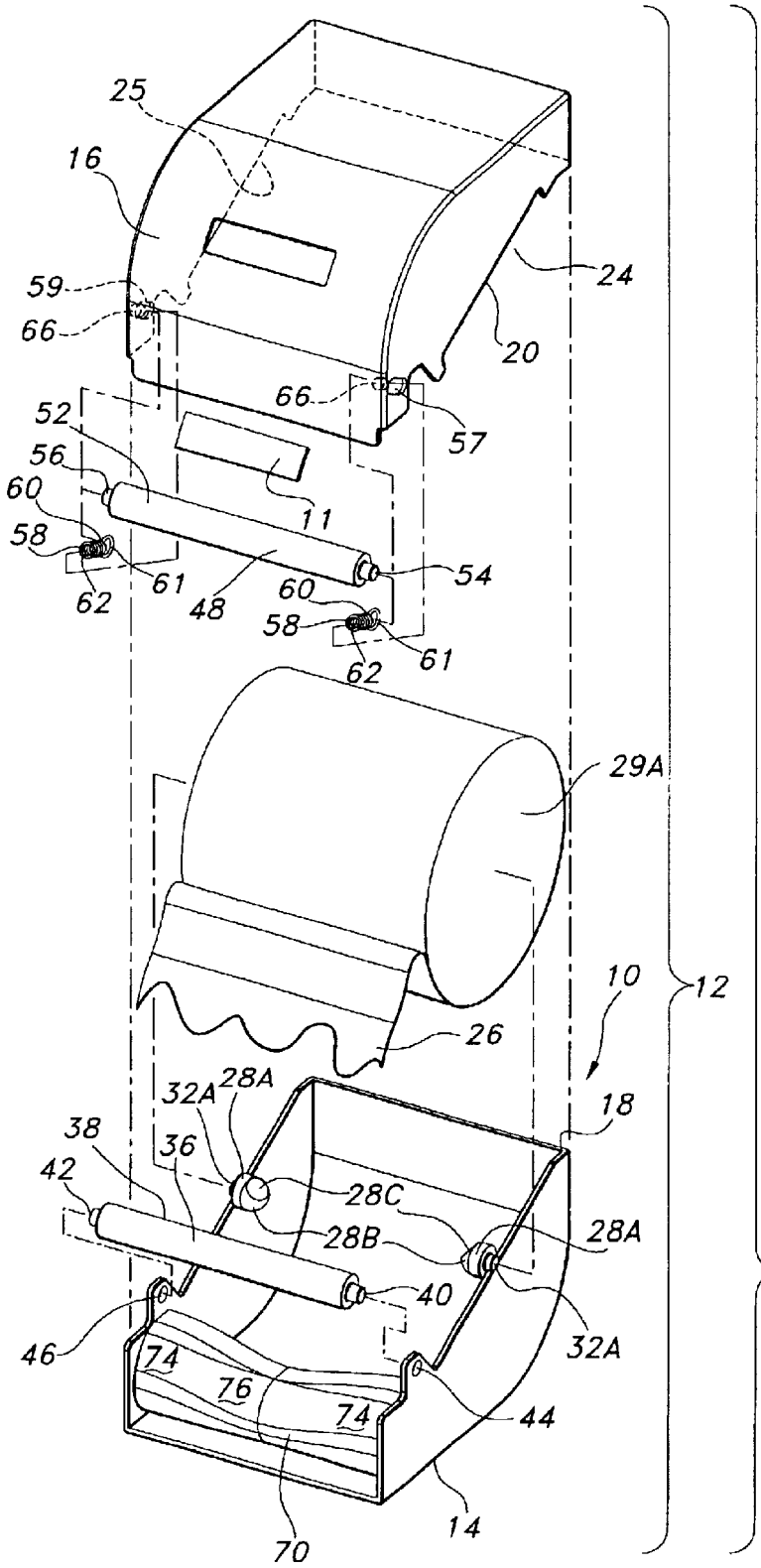
FIG. 2A is an exploded perspective view depicting the interior of an alternate embodiment.

Alternatively, referring now to FIG. 2A, the dispensing roller 28 of FIG. 2 may be replaced by first and second mobile roll supports 28A. This embodiment may be particularly desirable if the roll of sheet material is a coreless roll such as, for example, is taught in U.S. Pat. No. 5,875,985 to Cohen et al. and U.S. Pat. No. 6,070,821 to Mitchell. The mobile roll supports 28A have mobile roll support ends 32A that slideably engage the angled slots 24, 25. The mobile roll supports 28A also have an engaging member 28B adapted to engage one side of a roll of sheet material 29A. The engaging member 28B can have any one of numerous shapes. Desirably, the engaging member 28B further includes a chamfered surface 28C. In other embodiments, the engaging member 28B may be adapted to extend into the interior of the rolled sheet material 29A.

Referring again to FIG. 2, in one embodiment the roll of sheet material 29 may rotate independently from the dispensing roller body 30. In this embodiment, the roll of sheet material 29 will rotate around the dispensing roller body 30 as the sheet material 26 is dispensed. In another embodiment, the entire dispensing roller 28 including the dispensing roller body 30 and the dispensing roller ends 32, 34 may rotate with the roll of sheet material 29 as the sheet material 26 is dispensed. In a further embodiment, the dispensing roller body 30 may rotate with the roll of sheet material 29 while the dispensing roller ends 32, 34 remain fixed in the angled slots 24, 25 with respect to the rotating dispenser roller body 30 and roll of sheet material 29. In another embodiment, some combination of the aforementioned relationships between the angled slots 24, 25, the dispensing roller 28, and the roll of sheet material 29 may be used to effectively dispense the sheet material 26.

Figure 1A:
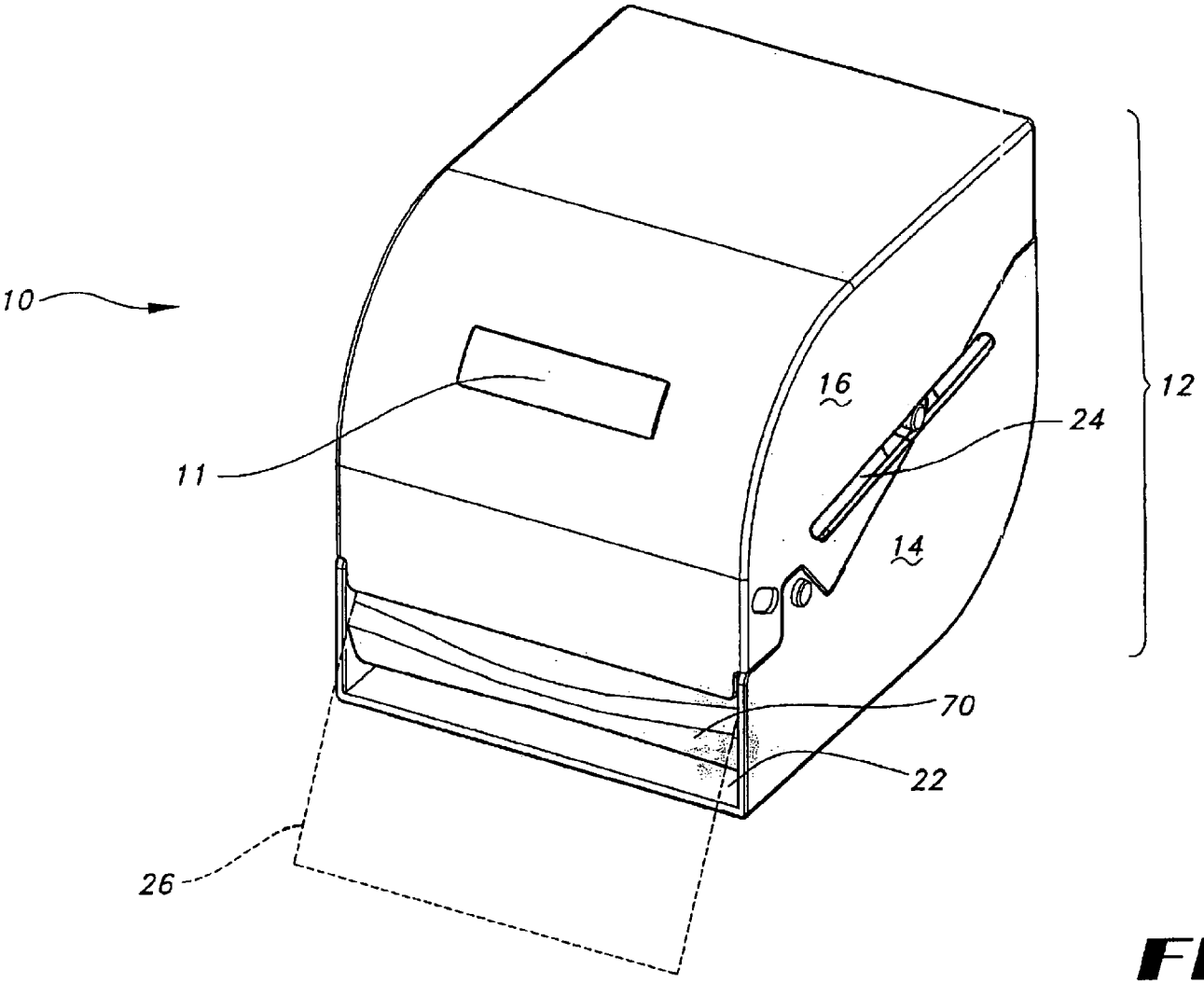
FIG. 1A is a perspective view of a dispenser of this invention.

As the sheet material 26 is dispensed and the diameter of the sheet material roll 29 decreases, the dispensing roller ends 32, 34 travel down the angled slots 24, 25. As depicted in FIG. 2, the angled slots 24, 25 may be formed between the first housing section 14 and the second housing section 16. Alternatively, in other embodiments the first and second angled slots 24, 25 may be defined entirely within the sides of the first housing section 14, may be defined entirely within the sides of the second housing section 16, or may cross over from the first housing section 14 to the second housing section 16 (as shown in FIG. 1A). It is desirable that the angled slots 24, 25 be open to the housing section edges 18, 20 to facilitate placement of the dispensing roller 28 in the angled slots 24, 25.

The angled slots 24, 25 have the added benefit of providing a window through which it is possible to detect how much sheet material 26 remains on the roll of sheet material 29 inside the housing 12. However, other embodiments may have tracks on the inside of the first housing section 14 and/or second housing section 16 with which the dispensing roller ends 32, 34 slidingly engage. As the roll of sheet material 29 is depleted, the dispensing roller ends 32, 34 travel within the tracks.

Referring again to FIG. 2, within the housing 12 is a feed roller 36 that provides further support to the roll of sheet material 29. The feed roller 36 has a feed roller body 38, a first feed roller end 40, and a second feed roller end 42. The first feed roller end 40 engages a first feed roller aperture 44 in the side of the first housing section 14. The second feed roller end 42 engages a second feed roller aperture 46 in the opposite side of the first housing section 14. The first and second feed roller apertures are positioned wherein the outer surface of a roll of sheet material 29 on the dispensing roller 28 will rest against the feed roller 36 as the roll of sheet material 29 is dispensed.

In one embodiment, the entire feed roller 36, including the feed roller body 38 and ends 40, 42, may rotate with the roll of sheet material 29 as the sheet material 26 is dispensed. In another embodiment, the feed roller body 38 may rotate with the roll of sheet material 29 while the feed roller ends 40, 42 remain fixed in the feed roller apertures 44. In a further embodiment, some combination of the aforementioned relationships between the roll of sheet material 29, the feed roller body 38, and the feed roller ends 40, 42 may be used to effectively dispense the sheet material 26.

Figure 3:
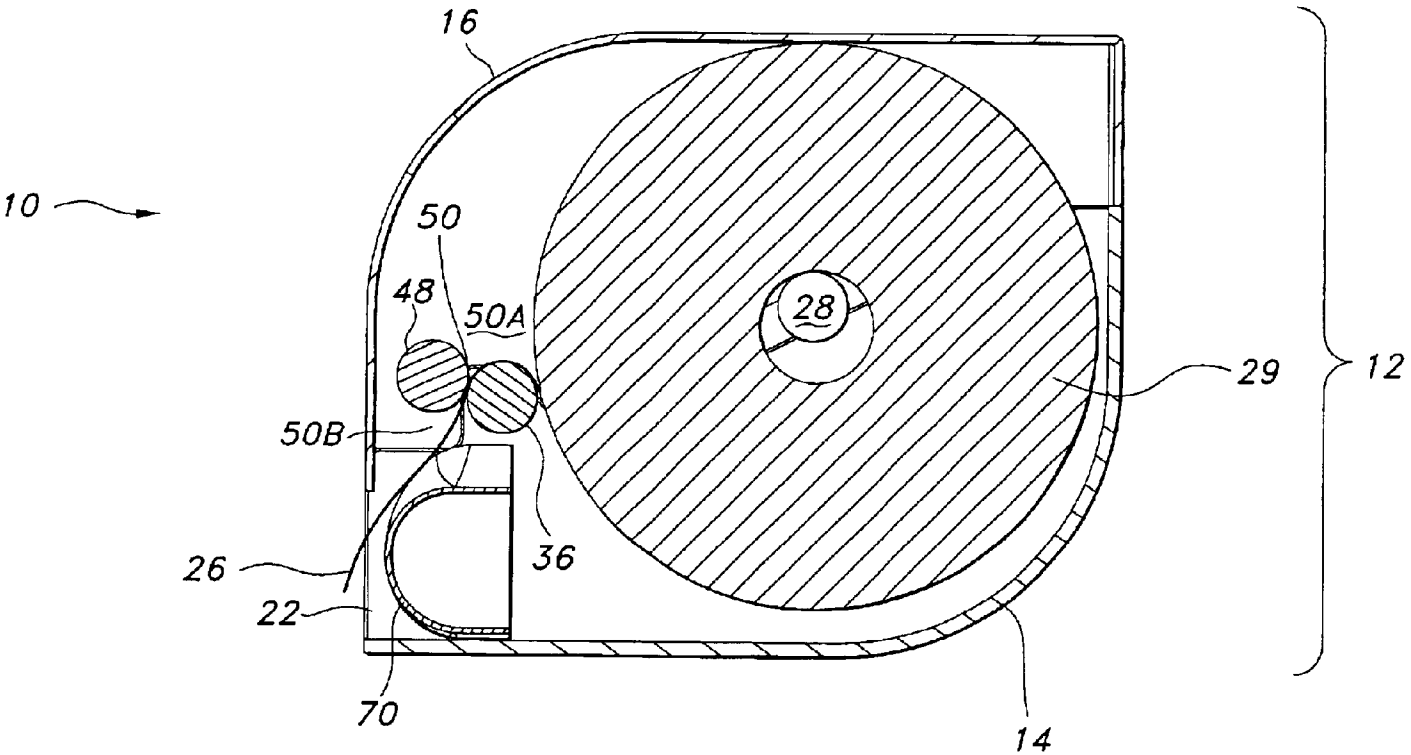
FIG. 3 is a cross-sectional side view of the dispenser of FIG. 1.

Within the housing 12 is a guide roller 48 having a guide roller body 52, a first guide roller end 54, and a second guide roller end 56. The first guide roller end 54 engages a first guide roller slot 57 in the side of second housing section 16. The second guide roller end 56 engages a second guide roller slot 59 in the opposite side of the second housing section 16. Referring now to FIG. 3, the guide roller 48 forms a nip 50 with the feed roller 36. The nip 50 has an entrance side 50A and an exit side 50B. Referring again to FIG. 2, the first and second guide roller slots 57, 59 are positioned in the sides of the second housing section 16 wherein the nip 50, shown in FIG. 3, is formed between the guide roller body 52 and the feed roller body 38 when the second housing section 16 is closed against the first housing section 14. The guide roller 48 is biased against the feed roller 36 by first and second springs 58 having first and second spring ends 60, 62. The first spring ends 60 are connected to hooks 61 that hook over the first and second guide roller ends 54, 56. The second spring ends 62 engage first and second pegs 66 attached to the inside of the second housing section 16. The guide roller slots 57 allow the guide roller 48 to move and the first and second springs 58 to compress as the first and second housing sections 14, 16 are closed together. Alternatively, other mechanisms known to those skilled in the art may be used for biasing the guide roller 48 against the feed roller 36.

The force exerted by the guide roller 48 against the feed roller 36 must be such that the tension required to be applied to the sheet material to pull it through the nip 50 exceeds the breaking strength of the zones of weakness in the sheet material yet does not exceed the breaking strength of the remainder of the sheet material 26. Therefore, force applied to the sheet material 26 extending from the dispensing opening 22 will advance the sheet material 26 until a zone of weakness emerges from the nip 50 between the guide roller 48 and the feed roller 36. At that point the zone of weakness will break, providing a single sheet to the patron, and leaving an extended tail of sheet material 26 for the next patron to grasp. A detailed description of the desired force balance can be found in U.S. Pat. No. 3,770,172 to Nystrand.

In one embodiment, the entire guide roller 48, including the guide roller body 52 and first and second guide roller ends 54, 56, may rotate as the sheet material 26 is dispensed. In another embodiment, the guide roller body 52 may rotate with the movement of the sheet material 26 while the guide roller ends 54, 56 remain fixed in the guide roller slots 57. In a further embodiment, some combination of the aforementioned relationships between the guide roller apertures 57, the guide roller 48, and the feed roller 38 may be used to effectively dispense the sheet material 26.

Figure 4A:
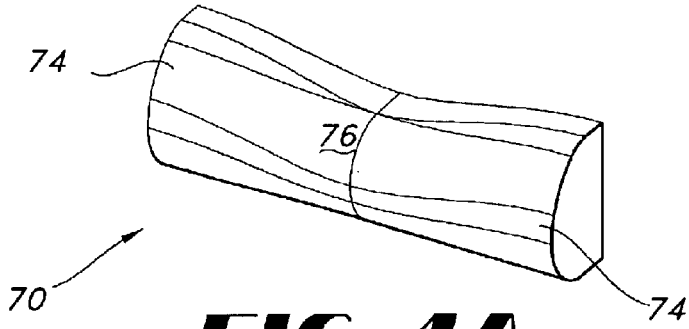
FIG. 4A is a perspective view of an exemplary dispensing surface for the dispenser of FIG. 1.
Figure 4B:
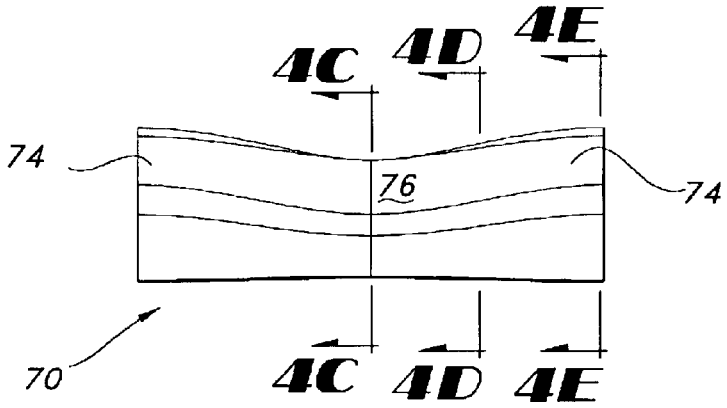
FIG. 4B is a front view of the dispensing surface of FIG. 4A.
Figure 4C:
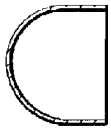
FIGS. 4C–4E are cross-sectional side views of the dispensing surface of FIG. 4A.
Figure 4D:
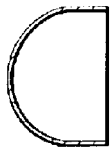
Figure 4E:
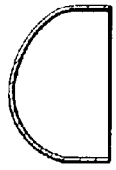

Referring again to FIG. 3, within the housing 12 and situated between the dispensing opening 22 and the exit side 50B of the feed nip 50, a sheet material dispensing surface 70 is positioned wherein during the dispensing operation the sheet material 26 travels over and upon the sheet material dispensing surface 70. In FIG. 3 the sheet material dispensing surface 70 is depicted beneath the path of the sheet material 26, but in other embodiments the sheet material dispensing surface 70 may alternatively be positioned above the path of the sheet material 26, or there may be first and second dispensing surfaces 70 positioned both above and below the path of the sheet material 26. Referring now to FIGS. 2, 4A, and 4B, the sheet material dispensing surface 70 has at least one protruding area 74 that contacts the sheet material 26 as the sheet material 26 is dispensed. The sheet material dispensing surface 70 also has at least one depressed area 76 that contacts the sheet material 26 with less force than does the protruding area 74, or not at all, during dispensing. Desirable shapes for the sheet material dispensing surface 70 include, but are not limited to, convex, concave, convex, concave, curved, rounded, bowed, arched, warped, dished, crenulated, and so forth. An exemplary profile for the dispensing surface 70 is depicted in FIGS. 4C–4E.

While the inventors do not wish to be held to a particular theory, it is thought that the dispensing force applied by a user to the sheet material 26 extending from the dispensing opening 22 is distributed to the areas of the sheet material 26 where the protruding area 74 contacts the sheet material 26 as it is dispensed. By concentrating the applied force in this manner, separation of individual sheets at the zones of weakness is more likely to occur.

Figure 5:
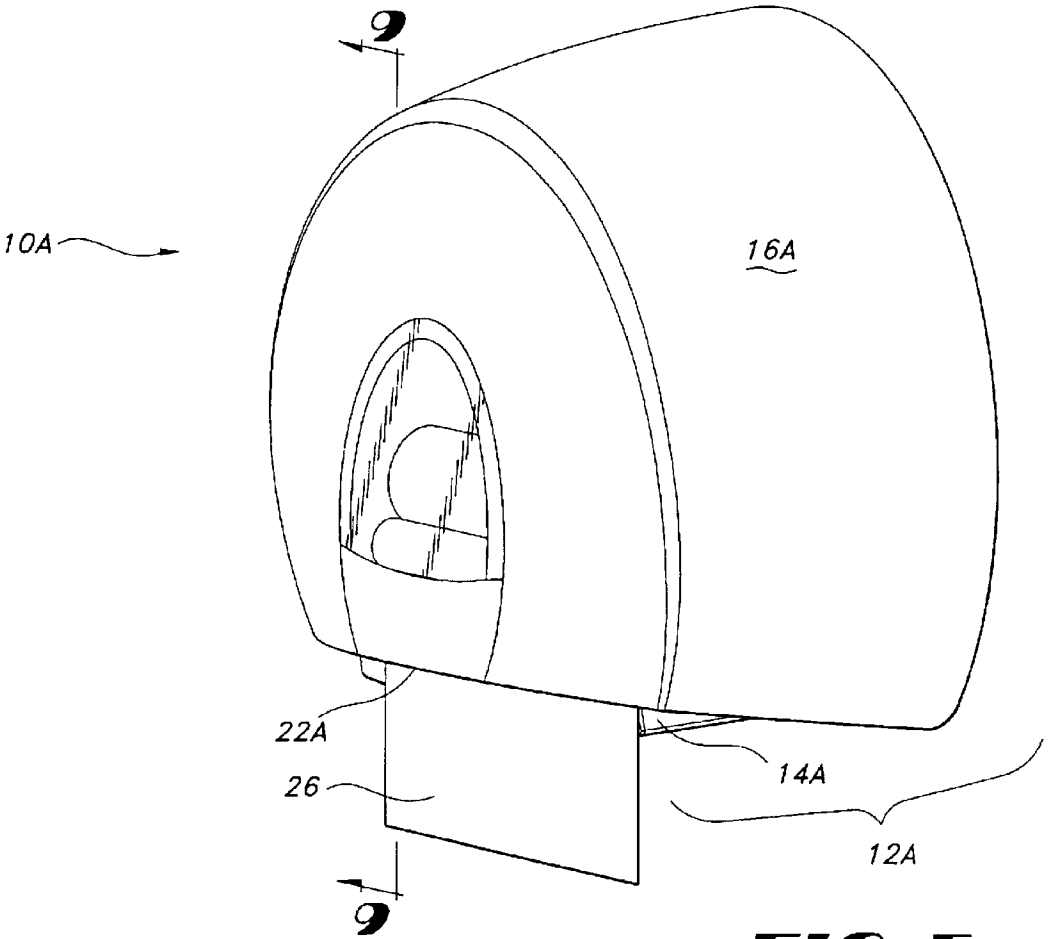
FIG. 5 is a perspective view of a dispenser of this invention.

An alternate embodiment is depicted in FIGS. 5–10E. Referring to FIG. 5, the dispenser 10A includes a housing 12A that comprises a first housing section 14A and a second housing section 16A. When the first housing section 14A and the second housing section 16A are in the closed position (as depicted in FIG. 5), the first housing section 14A and the second housing section 16A together define a dispensing opening 22A through which sheet material 26 is dispensed.

Figure 6:
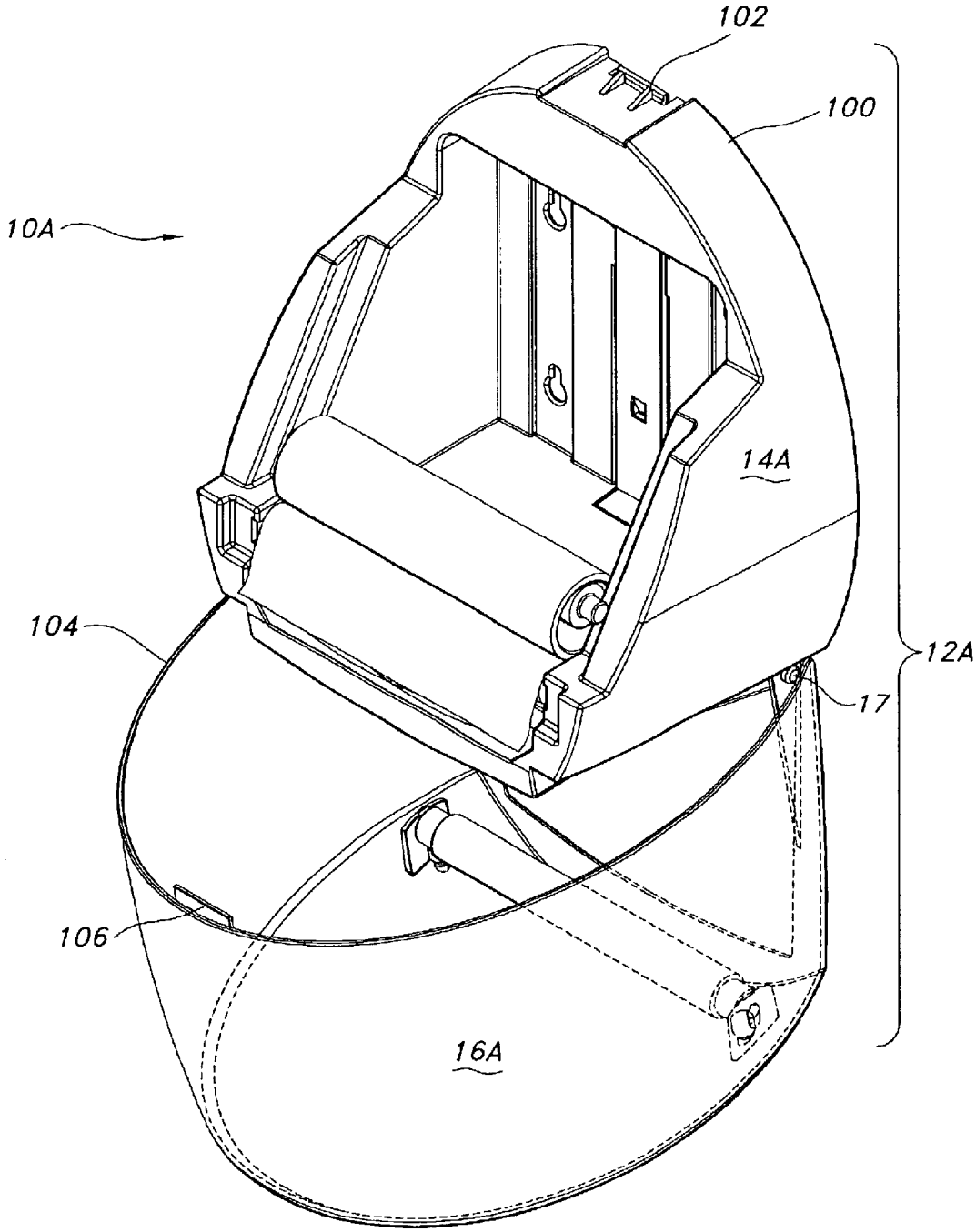
FIG. 6 is a perspective view depicting the interior of the dispenser of FIG. 5.

Referring now to FIG. 6 that depicts the inside of the dispenser 10A, the first housing section 14A has a top surface 100 to which is attached a first latch 102, while the second housing section 16A has a rim 104 to which is attached a second latch 106. The rim 104 fits around and over the first housing section 14A to form the housing 12A. The first latch 102 and the second latch 106 are configured to removably attach upon closing of the second housing section 16A such that the first housing section 14A and the second housing section 16A will not separate during the dispensing operation. However, when it is necessary to reload the dispenser, the first housing section 14A and the second housing section 16A are readily separated. Methods of removably attaching parts are well known to those skilled in the art. Nonlimiting examples include snaps, latches, buckles, locks, hooks, buttons, pins, cotter pins, and so forth. With respect to the particular embodiment depicted in FIGS. 6 and 7, the first housing section 14A and the second housing section 16A are pivotably attached by first and second hinges 17. The hinges 17 allow the housing 12A to be opened without complete separation of the first and second housing sections 14A, 16A.

Figure 7:
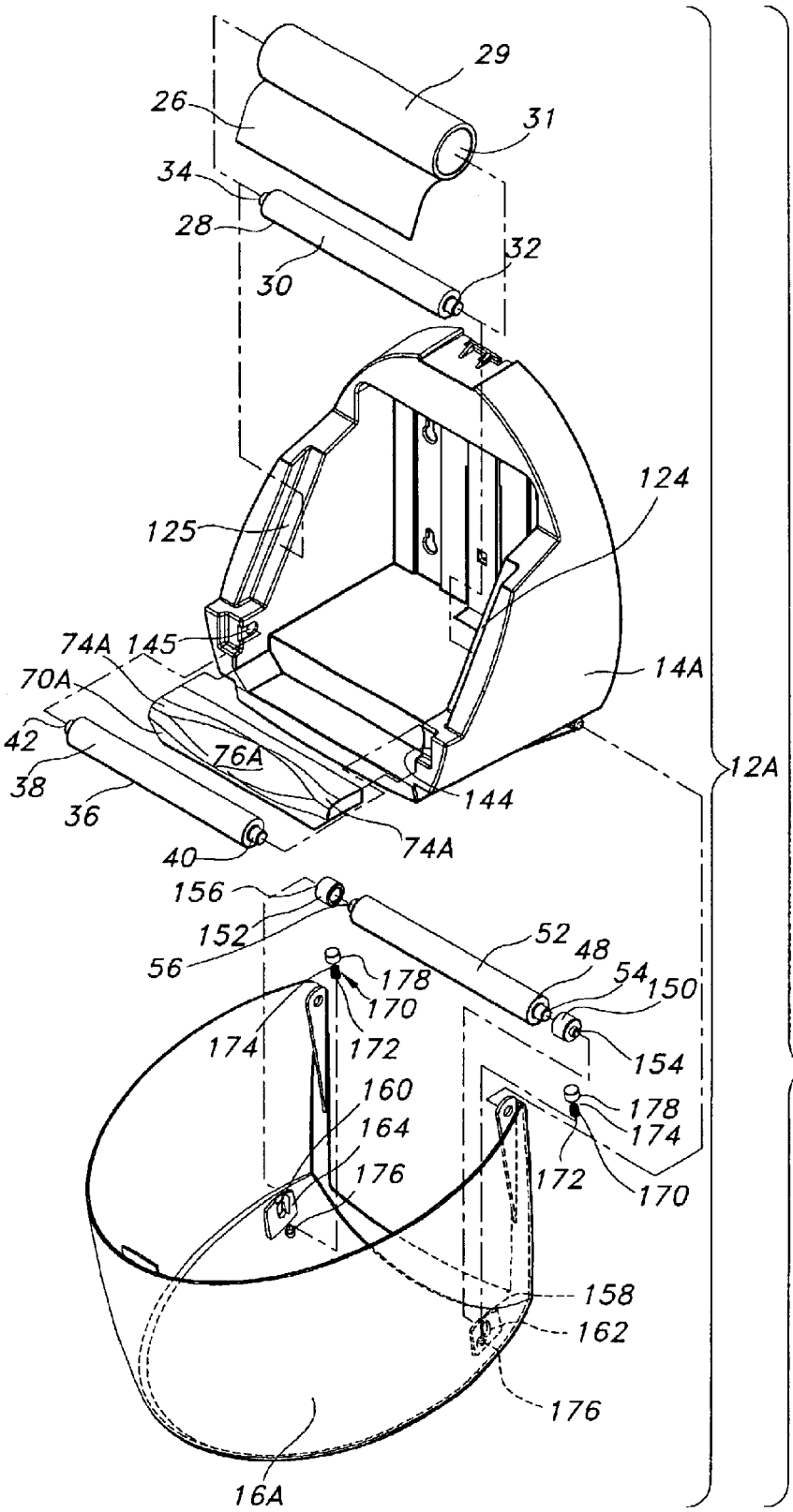
FIG. 7 is an exploded perspective view depicting the interior of the dispenser of FIG. 5.

In reference to FIG. 7, within the housing 12A is a dispensing roller 28 that is adapted to support a roll of sheet material 29 having a central aperture 31. The dispensing roller 28 has a dispensing roller body 30, a first dispensing roller end 32, and a second dispensing roller end 34. The dispensing roller body 30 is desirably cylindrical, but may be any other shape that will support the weight of the roll of sheet material 29. It is contemplated that the dispensing roller 28 may support the roll of sheet material 29 from within the central aperture 31 or, alternatively, may support the roll of sheet material 29 through contact with the outside surface of the roll of sheet material 29. The first and second dispensing roller ends 32, 34 are slidingly engaged by the first and second angled tracks 124, 125. The first and second dispensing roller ends 32, 34 may be fixed with respect to the dispensing roller body 30 or may, alternatively, rotate independently from the dispensing roller body 30. Similarly, as sheet material 26 is dispensed, the roll of sheet material 29 may be fixed with respect to the dispensing roller body 30, or may, alternatively, rotate independently from the dispensing roller body 30. As the sheet material 26 is dispensed and the diameter of the sheet material roll 29 decreases, the dispensing roller ends 32, 34 travel down the angled tracks 124, 125.

Also within the housing 12A is a feed roller 36 that provides further support to the roll of sheet material 29. The feed roller 36 has a feed roller body 38, a first feed roller end 40, and a second feed roller end 42. The first feed roller end 40 engages a first feed roller aperture 144 in the side of the first housing section 14A. The second feed roller end 42 engages a second feed roller aperture 145 in the opposite side of the first housing section 14A. The first and second feed roller apertures are positioned wherein the outer surface of a roll of sheet material 29 on the dispensing roller 28 will rest against the feed roller 36 as the roll of sheet material 29 is dispensed. As the sheet material 26 is dispensed, the feed roller body 38 rotates with the roll of sheet material 29. The feed roller body 38 may be fixed with respect to the first and second feed roller ends 40, 42, in which case the first and second feed roller ends 40, 42 rotate within the first and second feed roller apertures 144, 145. Alternatively, the feed roller body 38 may rotate independently from the first and second feed roller ends 40, 42.

Figure 8A:
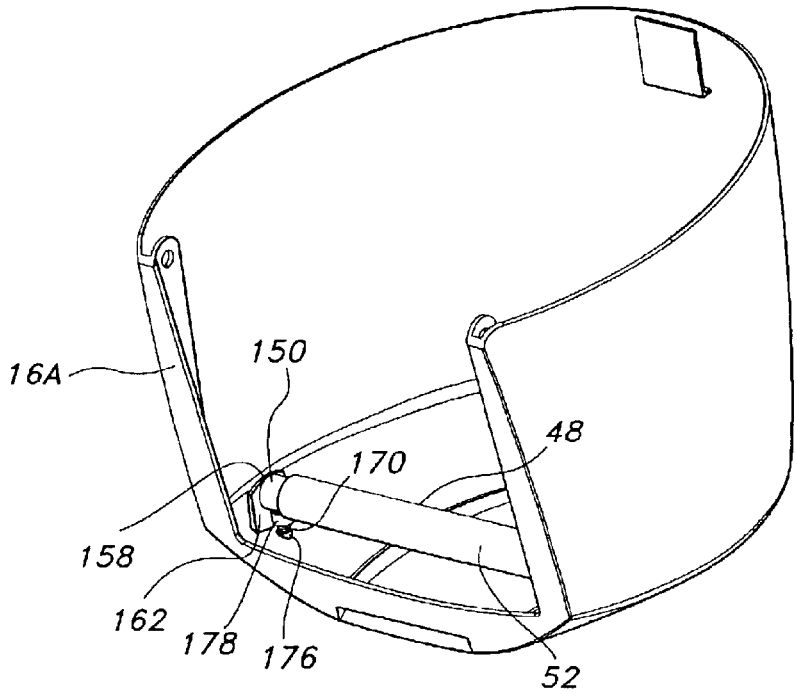
FIGS. 8A & 8B are fragmentary perspective views depicting the guide roller within the dispenser of FIG. 5.
Figure 8B:
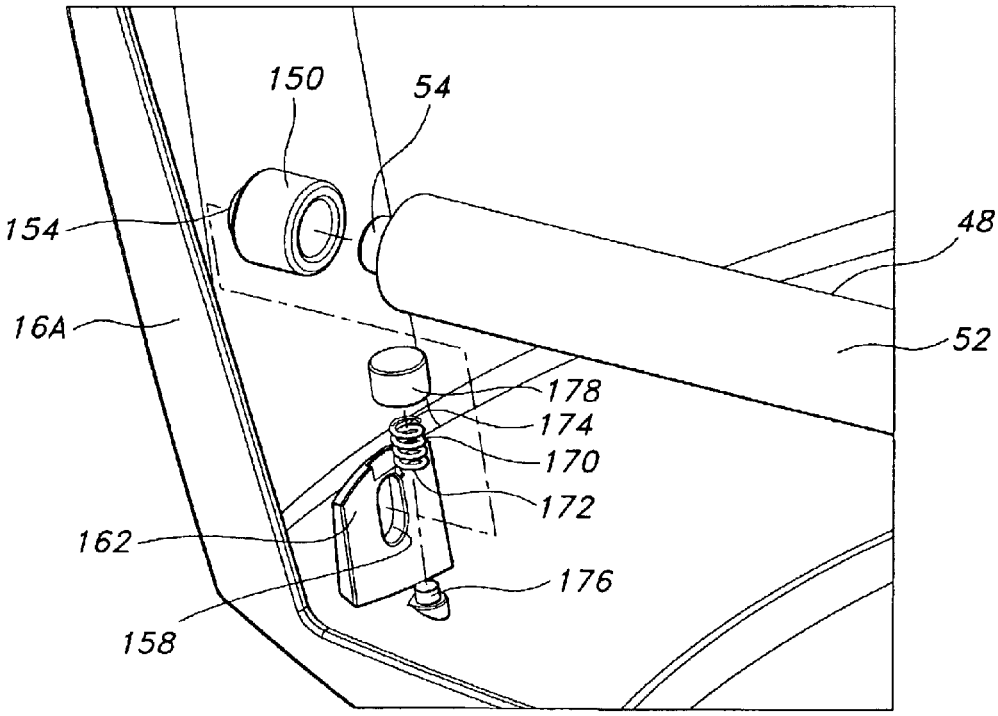

Additionally, referring also now to FIGS. 8A and 8B, within the housing 12A is a guide roller 48 having a guide roller body 52, a first guide roller end 54, and a second guide roller end 56. The first and second guide roller ends 54, 56 engage first and second guide roller bushings 150, 152 having first and second guide roller bushing ends 154, 156. The first and second guide roller bushing ends 154, 156 slidingly engage first and second guide roller bushing slots 158, 160 in first and second guide roller arms 162, 164 attached to the inside of the second housing section 16A.

Figure 9:
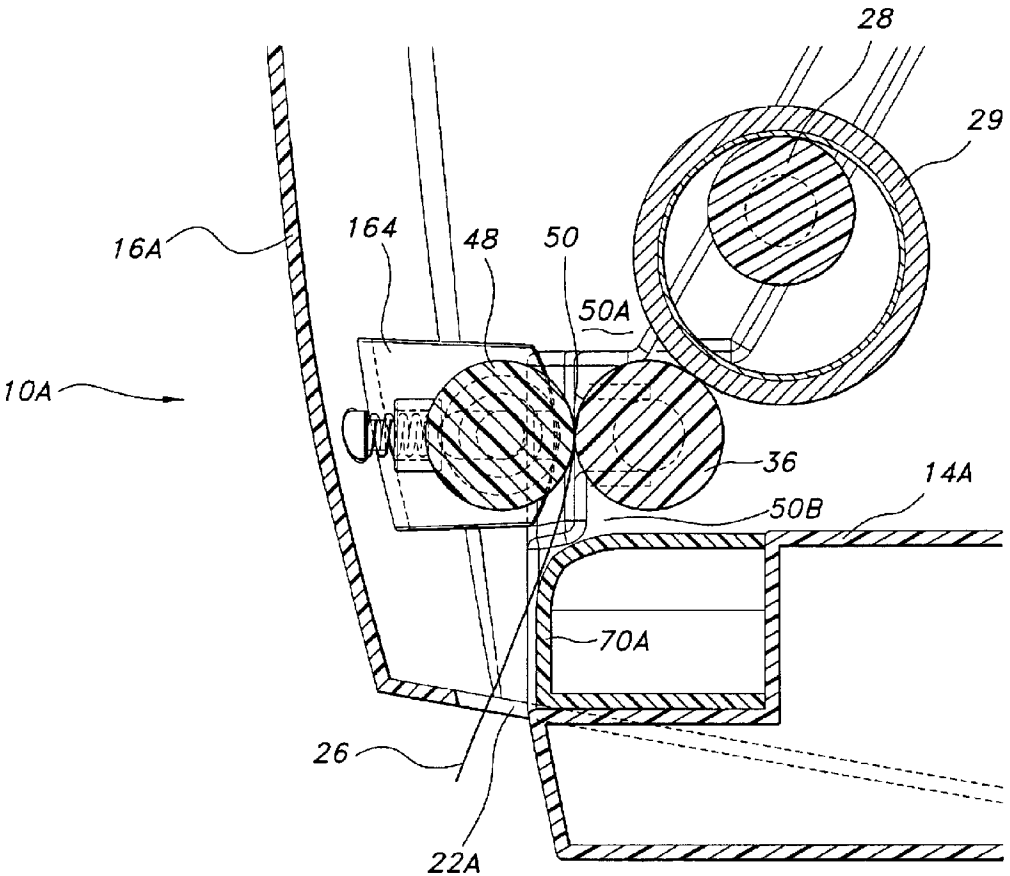
FIG. 9 is a fragmentary cross-sectional side elevation view of the dispenser of FIG. 5.

The guide roller 48 is biased between the second housing section 16A and the feed roller 36 by first and second springs 170 having first and second spring ends 172, 174. The first spring ends 172 engage first and second pegs 176 attached to the inside of the second housing section 16A. The second spring ends 174 engage first and second spring caps 178 against which rest the first and second guide roller bushings 150, 152. Referring now to FIG. 9, the guide roller 48 forms a nip 50 with the feed roller 36. The nip 50 has an entrance side 50A and an exit side 50B. The first guide roller arm 162 (not shown), and the second guide roller arm 164, attached to the inside of the second housing section 16A, are positioned wherein the nip 50 is formed between the guide roller 48 and the feed roller 36 when the second housing section 16A is closed against the first housing section 14A. As described above, the force exerted by the guide roller 48 against the feed roller 36 must be such that the tension required to be applied to the sheet material to pull it through the nip 50 exceeds the breaking strength of the zones of weakness in the sheet material yet does not exceed the breaking strength of the rest of the sheet material 26.

Figure 10A:
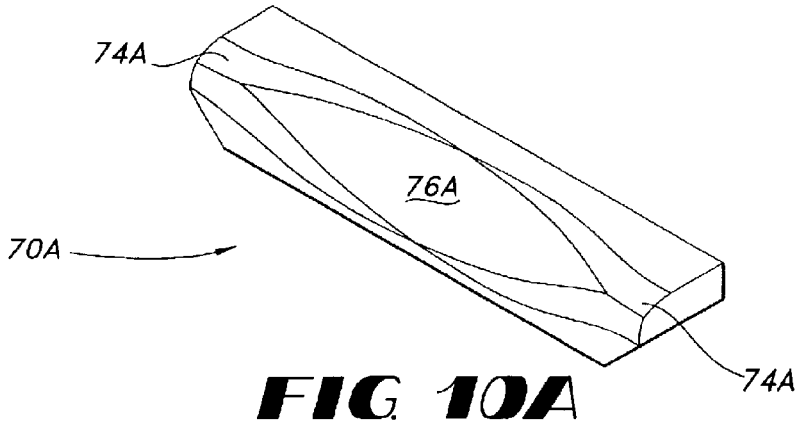
FIG. 10A is a perspective view of an exemplary dispensing surface for the dispenser of FIG. 5.
Figure 10B:
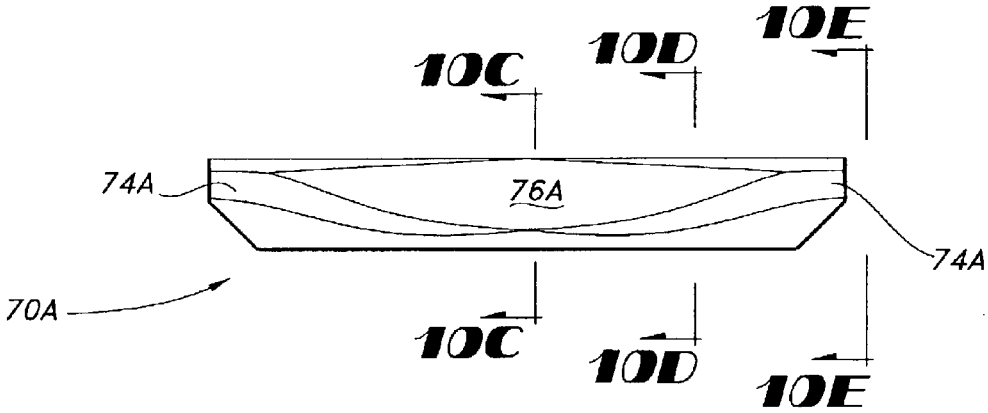
FIG. 10B is a front view of the dispensing surface of FIG. 1A.
Figure 10C:
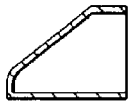
FIGS. 10C–10E are cross-sectional side elevation views of the dispensing surface of FIG. 10A.
Figure 10D:
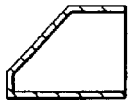
Figure 10E:
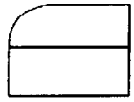

Referring now to FIG. 9, within the dispenser 10A and situated between the dispensing opening 22A and the exit side 50B of the feed nip 50, a sheet material dispensing surface 70A is positioned such that, during the dispensing operation, the sheet material 26 travels over and upon at least a portion of the sheet material dispensing surface 70A. In FIG. 9 the sheet material dispensing surface 70A is depicted beneath the path of the sheet material 26, but in other embodiments the sheet material dispensing surface 70A may alternatively be positioned above the path of the sheet material 26, or there may be first and second dispensing surfaces 70A positioned both above and below the path of the sheet material 26. Referring now to FIGS. 7, 10A, and 10B, the sheet material dispensing surface 70A has at least one protruding area 74A that contacts the sheet material 26 as the sheet material 26 is dispensed. The sheet material dispensing surface 70A also has at least one depressed area 76A that contacts the sheet material 26 with less force during dispensing than does the protruding area 74A. Desirable shapes for the sheet material dispensing surface 70A include, but are not limited to, convex, concave, curved, rounded, bowed, arched, warped, dished, crenulated, and so forth. An exemplary profile for the dispensing surface 70A is depicted in FIGS. 10C–10E.

While the inventors do not wish to be held to a particular theory, it is thought that the dispensing force applied by a user to the sheet material 26 extending from the dispensing opening 22A is increased in the areas where the protruding area 74A contacts the sheet material 26 as it is dispensed. By concentrating the force in this manner, separation of individual sheets at the zones of weakness is more likely to occur.

While the invention has been described in detail with respect to specific embodiments thereof, it will be apparent to those skilled in the art that various alterations, modifications and other changes may be made without departing from the spirit and scope of the present invention. It is therefore intended that all such modifications, alterations and other changes be encompassed by the claims.

We claim:

1. An apparatus for dispensing rolled sheet material comprising:

a housing defining an interior adapted to contain rolled sheet material and a dispensing opening for allowing sheet material to be dispensed from the interior of the the first and second housing sections each having a peripheral edge, housing, the housing comprising a first housing section and a second housing section, the first housing section being at least partially removably attached to the second housing section, wherein at least one slot is defined within the side of the housing and defined between the peripheral edges of the first and second housing sections;

a nip within the housing; and a mobile roll support system adapted to support a roll of sheet material within the housing wherein the roll of sheet material rotates to dispense sheet material, further wherein the slot engages the mobile roll support system, and further wherein the mobile roll support system and the roll of sheet material move toward the nip as sheet material is dispensed.

2. The apparatus of claim 1 further comprising first and second slots, each slot engaging the mobile roll support system wherein the mobile roll support system travels within the slots.

3. The apparatus of claim 2 wherein the first slot is parallel to the second slot.

4. The apparatus of claim 1 wherein the first housing section is pivotably attached to the second housing section.

5. The apparatus of claim 1 wherein at least one slot is angled downwardly to allow the mobile roll support system to move toward the nip as the sheet material is dispensed and the diameter of the roll of sheet material decreases.

6. The apparatus of claim 1 wherein the mobile roll support system comprises a dispensing roller having first and second ends, each end slideably engaging a slot.

7. The apparatus of claim 6 wherein the roll of sheet material defines a central core, and wherein the dispensing roller supports the roll of sheet material from within the central core.

8. The apparatus of claim 1 wherein the mobile roll support system comprises at least two mobile supports, each support slideably engaging a track.

9. The apparatus wherein at least one of the mobile supports comprises an engaging member attached to at least one of the supports, the engaging member adapted to engage one side of the roll of sheet material.

10. The apparatus of claim 9 wherein at least one engaging member is adapted to extend into the interior of the rolled sheet material.

11. The apparatus of claim 9 wherein the engaging member further comprises a chamfered surface.

12. The apparatus of claim 8 wherein the roll of sheet material is careless.

13. The apparatus of claim 1 wherein the roll of sheet material comprises inner and outer layers of sheet material, the layers of sheet material comprising a plurality of offset zones of weakness that extend substantially across the width of the sheet material.

14. The apparatus of claim 1 wherein the nip comprises at least one roller.

15. The apparatus of claim 1 wherein the nip is pressurized.

16. The apparatus of claim 14 wherein the nip is pressurized by at least one spring.

17. The apparatus of claim 16, wherein the roll of sheet material supported by the mobile roll support system rests against one of the nip rollers, and wherein the path of the sheet material extends through the nip and through the dispensing opening.

18. The apparatus of claim 1 further comprising a sheet material dispensing surface proximate the dispensing opening, the sheet material dispensing surface comprising at least one protrusion.

19. The apparatus of claim 18 wherein the sheet material dispensing surface comprises a fixed member located between the nip and the dispensing opening.

20. The apparatus of claim 19 wherein the fixed member is positioned between the nip and the dispensing opening to allow sheet material to travel along a circuitous path.

21. The apparatus of claim 18 wherein the sheet material dispensing surface is at least partially concave in shape.

22. The apparatus of claim 18 wherein the sheet material dispensing surface is at least partially convex in shape.

23. The apparatus of claim 18 wherein the sheet material dispensing surface comprises at least one concave portion.

24. The apparatus of claim 23 wherein the sheet material dispensing surface comprises at least one flat portion.

25. The apparatus of claim 18 wherein the sheet material dispensing surface comprises at least one convex portion.

26. The apparatus of claim 18 wherein the sheet material dispensing surface at least partially defines the dispensing opening.

27. The apparatus of claim 18 wherein the sheet material dispensing surface at least partially extends into the path between the nip and the dispensing opening.

28. The apparatus of claim 18 further comprising a roll of sheet material having a plurality of zones of weakness that substantially extend across the width of the sheet material, wherein the sheet material is dispensed along a path that extends from the roll of sheet material, through the nip, across the sheet material dispensing surface, and through the dispensing opening.

29. The apparatus of claim 28 wherein said protrusion concentrates force on the portion of the sheet material that contacts the protrusion when the sheet material is pulled across the sheet material dispensing surface and through the dispensing opening.

30. The apparatus of claim 28 wherein the rolled sheet material comprises inner and outer layers of sheet material, the layers of sheet material comprising a plurality of offset zones of weakness that substantially extend across the width of the sheet material.

* * * * *

UNITED STATES PATENT AND TRADEMARK OFFICE

CERTIFICATE OF CORRECTION

PATENT NO. : 6,902,134 B2
APPLICATION NO. : 10/242189
DATED : June 7, 2005
INVENTOR(S) : Green et al.

It is certified that error appears in the above-identified patent and that said Letters Patent is hereby corrected as shown below:

Column 9, lines 13-14, Claim 1, “the the” should read --the--;
Column 9, line 15, Claim 1, “housing, the housing” should read --the housing--.

Signed and Sealed this

Twenty-second Day of August, 2006

JON W. DUDAS
*Director of the United States Patent and Trademark Office*